US008313216B2

(12) United States Patent
Lai

(10) Patent No.: US 8,313,216 B2
(45) Date of Patent: Nov. 20, 2012

(54) ILLUMINATION DEVICE WITH OVERLAPPING ILLUMINATION AREA

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 318 days.

(21) Appl. No.: 12/853,321

(22) Filed: Aug. 10, 2010

(65) Prior Publication Data

US 2011/0090688 A1 Apr. 21, 2011

(30) Foreign Application Priority Data

Oct. 16, 2009 (CN) ..... 2009 1 0308342

(51) Int. Cl.
*F21V 1/00* (2006.01)
*F21S 4/00* (2006.01)

(52) U.S. Cl. ..... 362/249.02; 362/235; 362/249.01

(58) Field of Classification Search ..... 362/239, 362/242.01, 249
See application file for complete search history.

(56) References Cited

U.S. PATENT DOCUMENTS

| | | | | |
|---|---|---|---|---|
| 2006/0001055 | A1 | 1/2006 | Ueno et al. | |
| 2009/0213612 | A1 * | 8/2009 | Flehinghaus et al. | 362/542 |
| 2010/0199845 | A1 | 8/2010 | aus der Fuenten et al. | |
| 2010/0277906 | A1 * | 11/2010 | Choi et al. | 362/235 |

FOREIGN PATENT DOCUMENTS

| | | | |
|---|---|---|---|
| JP | P2004-200102 | A | 7/2004 |
| JP | P2005-115372 | A | 4/2005 |
| JP | P2008-27688 | A | 2/2008 |
| KR | 1020080054980 | A | 6/2008 |
| KR | 1020100090635 | A | 8/2010 |

* cited by examiner

*Primary Examiner* — Tracie Y Green
(74) *Attorney, Agent, or Firm* — Altis Law Group, Inc.

(57) ABSTRACT

An illumination device includes a housing, a cover and a plurality of lighting source modules. The plurality of lighting source modules is arranged in array. The cover includes a top surface and a bottom surface. The top surface faces the plurality of lighting source modules such that the light from the plurality of lighting source modules travels through the cover to the illumination area. Each of the plurality of lighting source modules has a predetermined height from the illumination area. A ratio of the total width of the lighting source modules to the predetermined height is less than or equal to a specific value, namely 10%, so that the illumination areas of all the plurality of lighting source modules substantially overlap.

8 Claims, 3 Drawing Sheets

ILLUMINATION DEVICE WITH OVERLAPPING ILLUMINATION AREA

BACKGROUND

1. Technical Field

The present disclosure generally relates to illumination devices, and particularly to an illumination device having substantially overlapping illumination areas of multiple lighting sources.

2. Description of Related Art

Joseph Bielecki et al. in IEEE, 23rd IEEE SEMI-THERM Symposium, "Thermal Considerations for LED Components in an Automotive Lamp." characterize light emitting diodes as a kind of semiconductor device changing current into light of specific wavelength. Light emitting diodes (LEDs) have many advantages, such as high luminosity, low operational voltage, low power consumption, compatibility with integrated circuits, easy driving, long term reliability, and environmental friendliness; thus, LEDs have been widely promoted as a lighting source.

Many illumination devices in popular use utilize multiple lighting source modules with respectively different illumination areas. As a result, dark areas occur between the areas and illumination is non-uniform. Moreover, if one or more lighting source modules malfunctions, the corresponding illumination areas will be dark.

What is needed, therefore, is an illumination device which can ameliorate the described limitations.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the multiple views.

DETAILED DESCRIPTION

Figure 1:
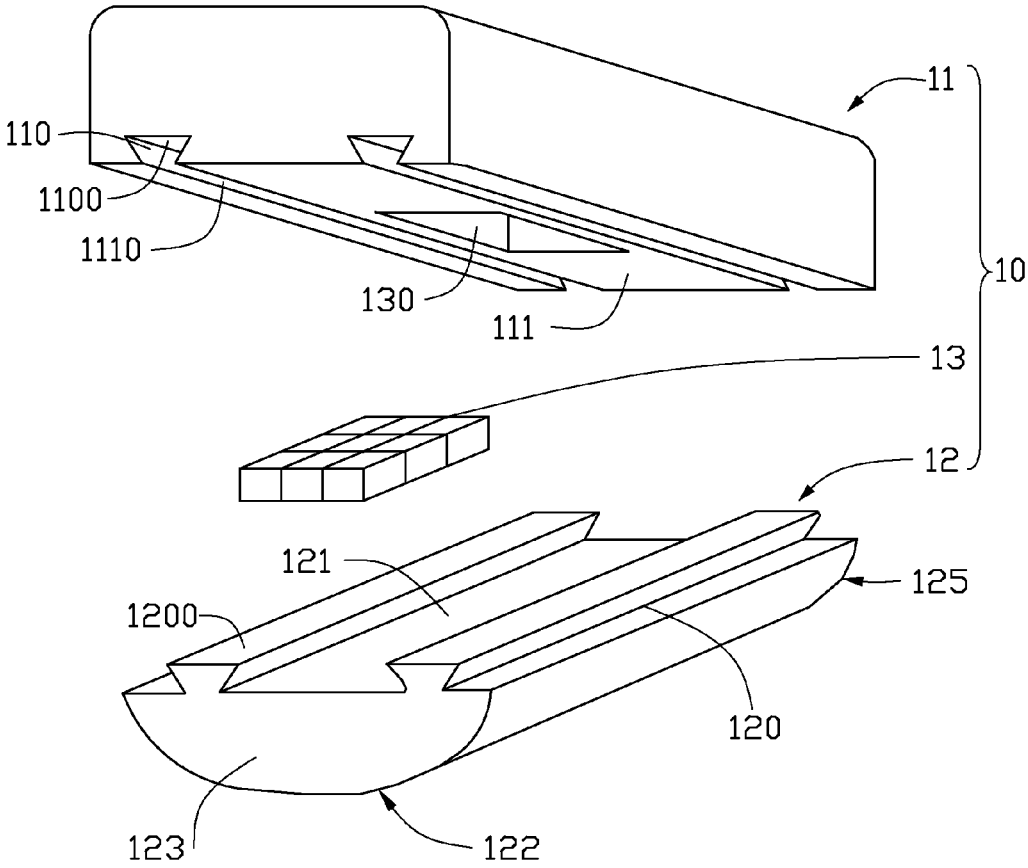
FIG. 1 is an exploded schematic view of an illumination device in accordance with a first embodiment.
Figure 2:
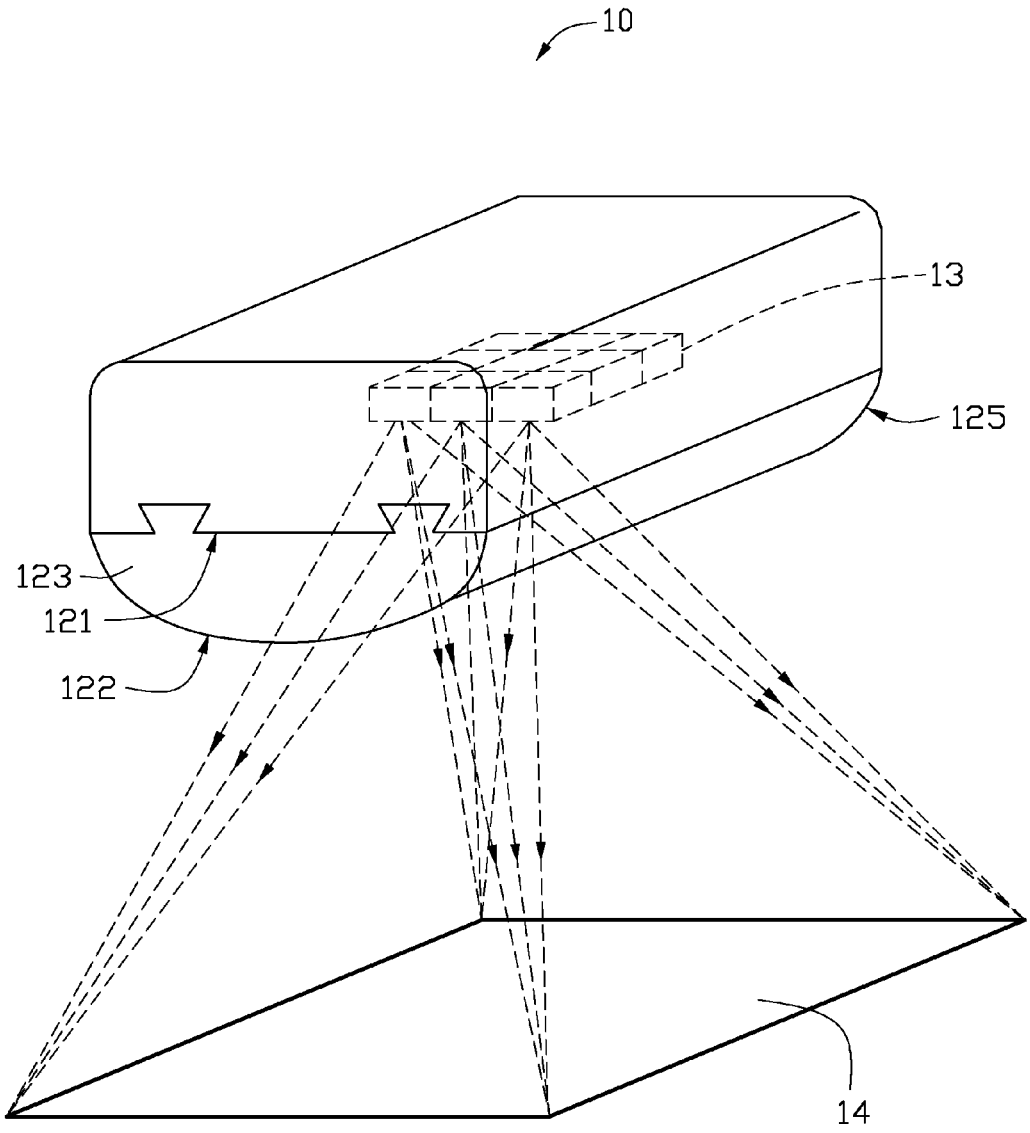
FIG. 2 is an illumination schematic view of different lighting source modules of the illumination device of FIG. 1.

Referring to FIG. 1 and FIG. 2, an illumination device 10 in accordance with a first embodiment includes a housing 11, a cover 12, and a plurality of lighting source modules 13.

The housing 11 is rectangular with a first bottom surface 111. The housing 11 includes a receiving chamber 130 defined in the center for receiving the plurality of lighting source modules 13. The bottom surface (not labeled) of the plurality of lighting source modules 13 is coplanar with the first bottom surface 111. The housing 11 defines two opposite grooves 110 configured at the two lateral sides. The surface of each groove 110 is trapezoidal in cross section. Each groove 110 defines an opening 1110 and a first top surface 1100 extending inwardly from the opening 1110. The first top surface 1100 is parallel to the first bottom surface 111 and the width of the first top surface 1100 exceeds the width of the opening 1110.

The length of the cover 12 including a curved structure is the same as the length of the housing 11. The cover 12 includes a rectangular first top surface 121, a second curved bottom surface 122, a first front surface 123 connecting to the first top surface 121 and the second curved bottom surface 122, and a first back surface 125 opposite to the first front surface 123 and also connecting the first top surface 121 and the second curved bottom surface 122. The first front surface 123 and the first back surface 125 are at the two ends of the cover 12 and connect to the first top surface 121 and the second curved bottom surface 122. The light from the plurality of lighting source modules 13 is emitted from the first top surface 121 and passes through the second curved bottom surface 122. The first front surface 123 and the first back surface 125 can be coated separately with a reflection film for reflecting the light from the plurality of lighting source modules 13 passing through the second bottom surface 122 to converge in a specific illumination area 14 (as shown in FIG. 2).

The cover 12 can be transparent material with a transmission rate exceeding 90% and a refraction rate between about 1.4 to about 1.7. In addition to polycarbonate (PC), the cover 12 can alternatively be polymethylmethacrylate (PMMA), silicone, epoxy and polyacrylate, or a glass containing a mixture of ZnO, B2O3, SiO2, Nb2O5, Na2O, or Li2O5. The cover 12 of the materials disclosed can reduce the weight of the whole illumination device 10 and promote ease of assembly and disassembly.

The cover 12 further includes two spaced first protrusions 120 protruding from the first top surface 121. Each of the first protrusion 120 is configured corresponding to the groove 110. The first protrusion 120 includes a rectangular second top surface 1200 parallel to the first top surface 121 and two side surfaces (not labeled) extending down from the two sides of the second top surface 1200 to the second top surface 121.

When the cover 12 is assembled with the housing 11, the first protrusion 120 slides along the groove 110 until both are securely fastened. In this condition, the first top surface 1100 and the second top surface 1200 snugly contact, as are the first bottom surface 111 and the second bottom surface 121. The cover 12 can seal the receiving chamber 130 to protect the plurality of lighting source modules 13 inside the receiving chamber 130 from contamination from the exterior. The plurality of lighting source modules 13 can include solid state lighting sources such as light emitting diodes (LEDs), or other lighting elements, such as incandescent lights. In this embodiment, the lighting source modules 13 are LEDs. In other embodiments, the housing 11 and the cover 12 can be integrated into a single body.

Figure 3:
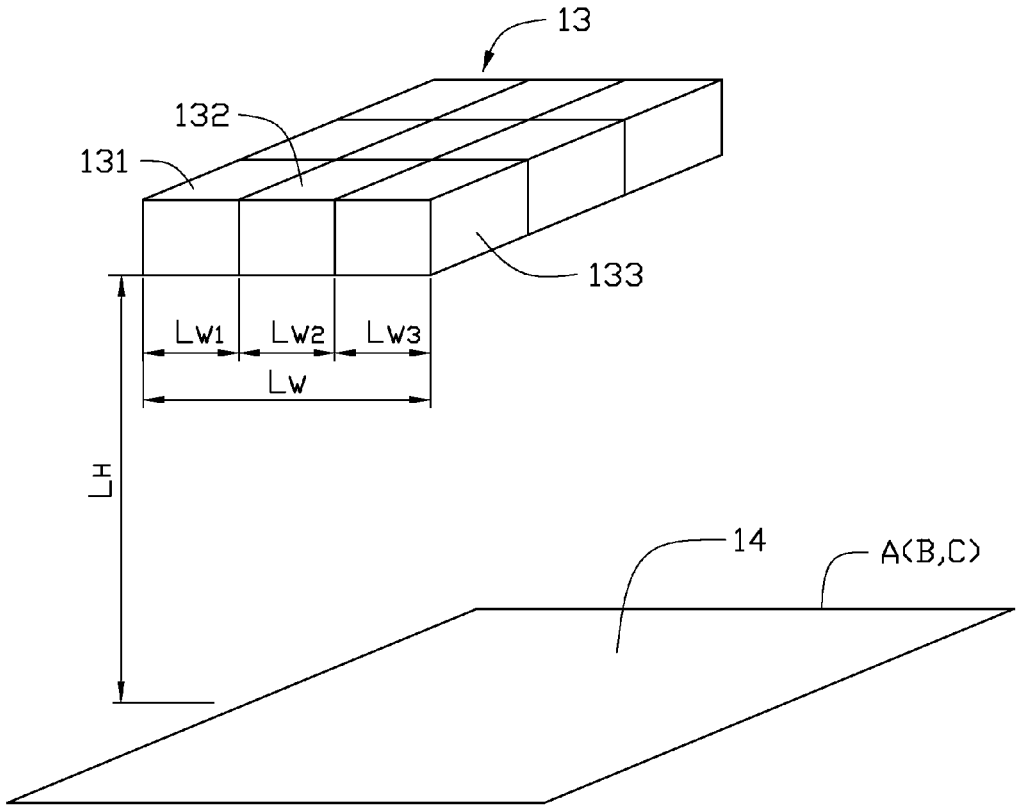
FIG. 3 is a schematic view of the different lighting source modules of the illumination device of FIG. 1, relative to an illumination area.

Referring to FIG. 3, the plurality of lighting source modules 13 is arrayed, and includes at least a first LED module 131, a second LED module 132, and a third LED module 133. In this embodiment, the three LED modules 131, 132, 133 snugly contact. However, there can be also a specific space between each other. The first LED module 131 has a width of $L_{w1}$, the second LED module 132 has a width of $L_{w2}$, the third LED module 133 has a width of $L_{w3}$, such that total width of the plurality of lighting source modules 13 is $L_w$ ($L_{w1}+L_{W2}+L_{W3}$). The height of the vertical distance from the plurality of lighting source modules 13 to the specific illumination area 14 is $L_H$. The first LED module 131 illuminates a section A in the specific illumination area 14, the second LED module 132 illuminates a section B in the specific illumination area 14, and the third LED module 133 illuminates a section C in the specific illumination area 14. When the ratio of the total width Lw to the height $L_H$ is less than or equal to 10% ($L_W/L_H \leqq 10\%$), then the illuminated sections A, B, and C are substantially the same and the three LED modules 131, 132, 133 can be regarded as a point light source. In other words, the illuminated sections A, B, and C substantially overlap and the light fields are uniform. Preferably, the ratio of the total width Lw to the height LH is less than or equal to 5% ($L_W/L_H \leqq 5\%$)

The cover 12 can be used to adjust the direction of the light from the plurality of lighting source modules 13 with an optical adjustment. For example, convergence or divergence of the light from the plurality of lighting source modules 13 can adjust the illumination area of the plurality of lighting source modules 13. The light incident surface 121 can be planar and the light emitting surface can be curved.

When it is needed, the plurality of lighting source modules 13 can further include at least one optical element (not shown), such as a lens, a diffuser, a reflector, or a light guiding plate for adjusting the light from the lighting source modules 13.

It is to be understood, however, that even though numerous characteristics and advantages of the disclosure have been set forth in the foregoing description, together with details of the structures and functions of the embodiment(s), the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An illumination device comprising:

a housing comprising a groove and a receiving chamber defined in a bottom surface of the housing;

a cover covering the housing, the cover comprising a first protrusion protruding from a first top surface of the cover and being configured to be received in the groove; and a plurality of lighting source modules arranged in an array and received in the receiving chamber for emitting light through the cover to illuminate an area, wherein a ratio of a total width of the array to a distance between the lighting source modules and the area is less than 10%.

2. The illumination device as claimed in claim 1, wherein the ratio of the total width of the array to the distance between the lighting source modules and the area is less than 5%.

3. The illumination device as claimed in claim 1, wherein the cover is transparent material.

4. The illumination device as claimed in claim 1, wherein the plurality of lighting source modules are solid state lighting, source modules.

5. The illumination device as claimed in claim 4, wherein the solid state lighting source modules are LED modules.

6. The illumination device as claimed in claim 1, wherein the over comprises two lateral surfaces and the two lateral surfaces are coated with reflection films respectively.

7. The illumination device as claimed in claim 1, wherein the cover is polymethylmethacrylate, poly carbonate, silicone, epoxy, polycrylate, or glass containing ZnO, $B_2O_3$, $SiO_2$, $Nb_2O_3$, $Na_2O$, or $Li_2O_5$.

8. The illumination device as claimed in claim 1, wherein the first protrusion is configured to slide along the groove until both the first protrusion and the housing are securely fastened when the cover is assembled with the housing.

* * * * *